United States Patent [19]

Manzer

[11] Patent Number: 4,503,625

[45] Date of Patent: Mar. 12, 1985

[54] TANK SYSTEM FOR COLD FIXING A TONER POWDER

[75] Inventor: Hans Manzer, Seefeld, Fed. Rep. of Germany

[73] Assignee: Siemens Aktiengesellschaft, Berlin & Munich, Fed. Rep. of Germany

[21] Appl. No.: 523,608

[22] Filed: Aug. 16, 1983

[30] Foreign Application Priority Data

Aug. 31, 1982 [DE] Fed. Rep. of Germany ..... 3232369

[51] Int. Cl.[3] ..... F26B 21/06

[52] U.S. Cl. ..... 34/78; 354/297; 354/300; 354/324; 355/10; 432/59

[58] Field of Search ..... 34/78, 94, 95; 432/8, 432/59; 378/28; 355/10; 354/297, 300, 324

[56] References Cited

U.S. PATENT DOCUMENTS

| | | | |
|---|---|---|---|
| 4,081,816 | 3/1978 | Geyken et al. | 354/297 |
| 4,166,728 | 9/1979 | Degenhardt et al. | 354/300 |
| 4,248,514 | 2/1981 | Watkins | 354/324 |
| 4,264,304 | 4/1981 | Hausmann | 432/59 |

FOREIGN PATENT DOCUMENTS

| | | | |
|---|---|---|---|
| 3117071 | 11/1982 | Fed. Rep. of Germany . | |
| 118036 | 9/1980 | Japan | 354/300 |
| 870876 | 10/1981 | U.S.S.R. | 34/78 |

*Primary Examiner*—Edward G. Favors
*Assistant Examiner*—Steven E. Warner
*Attorney, Agent, or Firm*—Hill, Van Santen, Steadman & Simpson

[57] ABSTRACT

A tank system for cold fixing a toner powder on a paper as it is conducted through a fixing station of a non-mechanical high speed printing and copying device characterized by the printed paper being conducted through an atmosphere enriched with the vapor of a fixing agent. The tank system includes an injection tank which is connected to a replaceable feed container containing the agent with the injection tank being controlled to inject the agent into the fixing station to maintain the desired concentration of the vapor. The system also includes a recovery device including a water separator which separates condensed fixing agent from the water of the condensate. The system also includes a buffer tank which receives the recovered fixing agent, a pressure tank which is coupled to the buffer tank and has an outlet with a valve connected to the supply system, and an air pump to supply compressed air to the pressure tank to return any agent in the tank into the feed container and/or into the injection tank.

10 Claims, 7 Drawing Figures

100
1
2
3
4
5
6
7
8
9
10
11
12
13
14
15
16
17
18
19
20
21
22
23
24
25
26
27
28
126
80
81
To 18
From 126
Air Pump
Warning Light

TANK SYSTEM FOR COLD FIXING A TONER POWDER

BACKGROUND OF THE INVENTION

The present invention is directed to a tank system for cold fixing a toner powder on a paper as it is conducted through a fixing station of a non-mechanical high speed printing and/or copying device by exposing the printed paper to an atmosphere enriched with vapors of a fixing agent. The tank system includes a fixing station having an injection tank containing the fixing agent and having means for creating a vapor of the agent in the fixing station, means for collecting a condensate of the vapor of the fixing agent and delivering the condensate to recovery means for separating the fixing agent from the collected condensate and supply means for providing an agent to the injection tank including an exchangeable feed container.

In copiers and non-mechanical high speed printers, the toner powder, which is transferred to a data carrier for example a web of paper, can be fixed with the assistance of vapors of a solvent which is a fixing agent. In this process which is known as a cold fixing process, the endless paper, which is covered with black synthetic powder, is conducted through a chamber in which an atmosphere enriched with the solvent causes the synthetic particles to dissolve and to adhere and thus produces a cross linking adhesion of the powder to the paper. In order to supply the fixing station with the solvent, it has already been proposed that a tank system be used. In this tank system the fixing station itself is preceded by an injection tank through which a liquid fixing agent is sprayed onto a hot plate in the fixing station and is thus vaporized. The injection of the agent from the injection tank is controlled by a sensing device or means which determines the amount or concentration of the vapor in the fixing station and maintains the concentration at a theoretical value. The fixing station itself will also contain a cold sluice in which the consumed fixing agent will be condensed and deposited and is thus mixed with water. The system also has a fixing agent recovery system which contains a water separator which enables recovering of the fixing agent by precipitation from the water. A pump system is used to return the solvent of the fixing agent to the injection tank in the fixing station after appropriate filtering. The recovered agent is then mixed with fresh fixing agent which is supplied from an exchangeable bottle or container.

An essential problem with regard to the transportation of the solvent, which has a decisively low boiling point, occurs when conventional liquid pumps are used. This is due to the low pressure on the suction side of the pump possibly in combination with the increased temperature of the agent resulting in expansion and evaporation which will substantially reduce the conveyance efficiency of the pump and can lead to disturbances resulting from gas formation.

These characteristics of the solvent also necessitate that the entire tank system be hermetically sealed from the environment so as to prevent the undesirable escape of the solvent. Critical zones of such tank systems consist on the one hand in the region of the cold sluice of the fixing station and on the other hand of the coupling zones between the solvent feed containers, which consist of bottles, and the tank system itself.

In order to ensure continuous operation, in particular in non-mechanical high speed printers, it is necessary that the exchangeable feed container should be such as to permit a rapid and problem free exchange or replacement. The supply of solvent to the fixing station should not be interrupted during this exchange process.

SUMMARY OF THE INVENTION

The object of the present invention is to design a tank system of the above mentioned type in such a manner as to ensure reliable and easy handling of the fixing agent contained in exchangeable feed containers together with functionally accurate and environmentally harmless replenishment of the fixing agent and in this way to facilitate undisturbed transportation of the fixing agent.

This object is realized in an improvment in a tank system for cold fixing a toner powder on a paper as it is conducted through a fixing station of a non-mechanical high speed printing and copying device by exposing the printed paper to the atmosphere enriched with vapors of the fixing agent. The tank system includes a fixing station having an injection tank containing the fixing agent and having means for creating a vapor of the agent in the fixing station, means for collecting a condensate of the vapors of the fixing agent and delivering the condensate to recovery means for separating the fixing agent from the collected condensate, and supply means for providing additional amounts of the agent to the injection tank including an exchangeable feed container. The improvement comprises the tank system including a pressure tank having an outlet connected to the supply means, a buffer tank for receiving the agent from the recovery means being connected to the pressure tank by a conduit with a valve, pump means for applying an air pressure on the pressure tank to cause a flow of the agent in the pressure tank into the feed container and to the injection tank and control means for actuating the pump means in response to a sensed low level in the injection tank.

Preferably, the buffer tank is connected to the pressure tank by both a supply pipeline or conduit having a first valve and by a ventilating pipeline or conduit which contains a second valve. The supply means for providing an additional amount of the agent to the injection tank has a pipeline or conduit extending from the container to the pressure tank having a third valve and a branch line with a fourth valve being connected between the third valve and the container and extending to the pressure tank.

In order to be able to exchange containers, the supply means includes an arrangement for sealing and receiving a container of the agent which means after insertion of the container in a sealed relationship opens the valve on the container to communicate it with the pipelines or conduits of the supply means.

The tank system in accordance with the present invention enables a disturbance free transportation of the solvent without the formation of gas within the system. When the feed containers, which are in the form of bottles, are exchanged, solvent is unable to escape into the surrounding atmosphere since the operating pressures must not be broken during the exchange process. Since the exchangeable feed container itself serves as an intermediate tank for the recovered solvent, the number of buffer tanks in the system is reduced to a minimum. Hermetic seals of the entire system results in an enviromentally safe design and a functionally reliable mode of operation. Since no mechanical pumps are used to transport the solvent, no disturbances can occur as a result of the wear phenomena particularly since the use of compressed air for the transportation of the solvent produces a self cleansing effect in the tank.

BRIEF DESCRIPTION OF THE DRAWINGS

FIG. 5 illustrating the device with the container being substantially received therein; FIG. 6 showing the container entirely inserted within the device and FIG. 7 illustrating the first step of removing the container during an exchange of containers.

DESCRIPTION OF THE PREFERRED EMBODIMENTS

Figure 1:
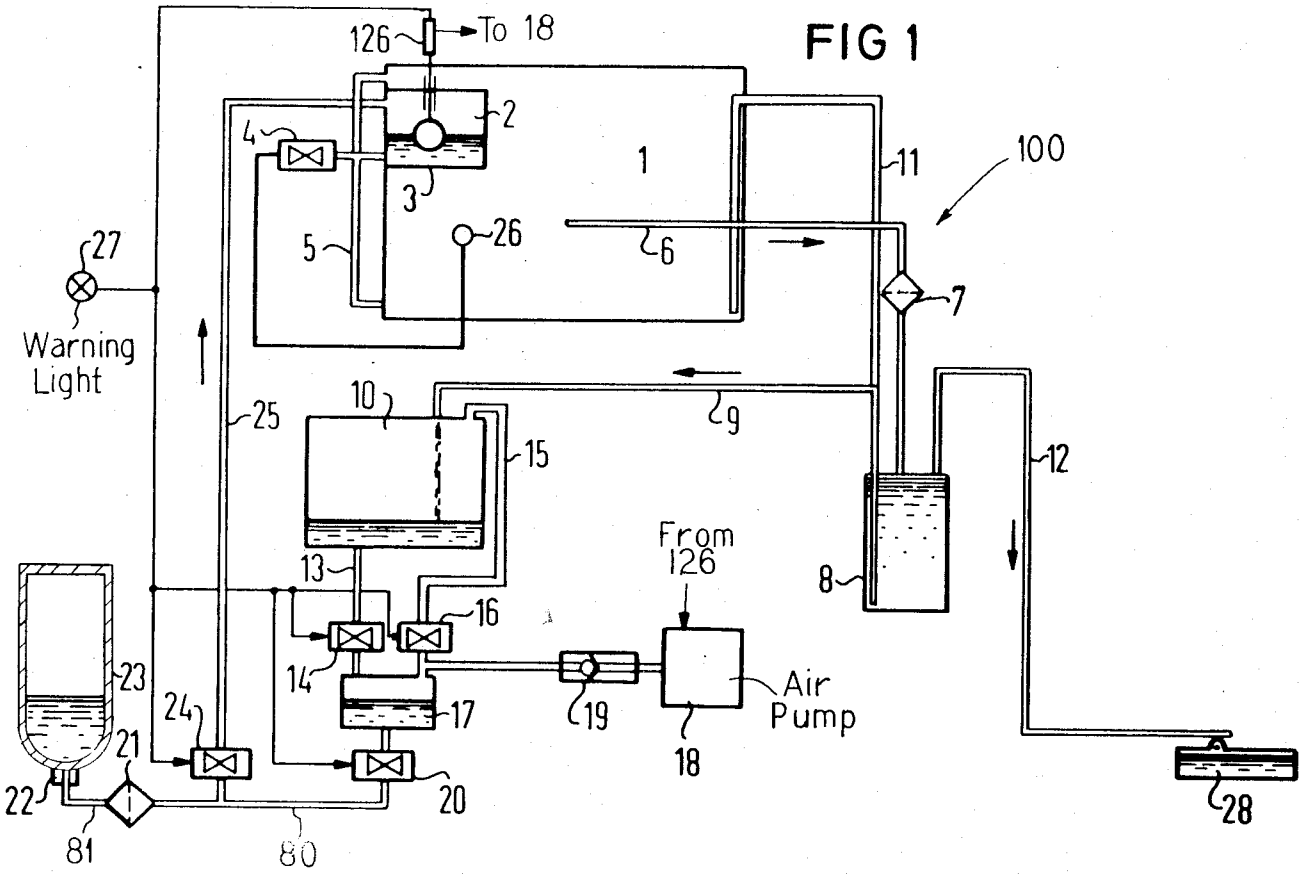
FIG. 1 is a schematic presentation of the tank system in accordance with the present invention.

The principles of the present invention are particularly useful in a tank system which is schematically illustrated in FIG. 1 and generally indicated at 100. The tank system 100 is for cold fixing of a toner powder on paper for a non-mechanical high speed printer which contains a fixing station 1. The station 1 has a chamber through which a web of endless paper covered with a black synthetic powder is conducted. An atmosphere enriched with the solvent is present in the chamber and causes the synthetic powders to dissolve and become attached and thus produces a cross linking adhesion to the paper. The fixing station 1 contains an injection tank 2 with a float 3 which serves as a level regulating means. The float 3 is part of control means which has a level sensor 126 that will be discussed hereinafter. Disposed in the fixing station 1 is a sensor 26 which monitors the solvent concentration and emits a signal that open and closes a magnetic valve 4 which controls flow from the injection tank 2 through an injection pipe line or conduit 5 which extends to a bottom portion of the fixing station to discharge solvent onto a heated bottom wall of the station 1 to create a vapor.

In a known manner, the fixing station 1 contains a cold sluice, which serves to condense the solvent in the region of the outlet point for the endless paper and to supply the solvent enriched with water via a condensate outlet 6 through an associated filter 7 to recovery means including a water separator 8. This water separator serves to remove the water contained in the solvent from the solvent whereupon the dehydrated solvent is fed via a supply pipeline or conduit 9 to a buffer tank 10. To enable ventilation of the system, the supply pipe 9 is connected via a branch 11 to the fixing station 1. In addition, another conduit or pipeline 12 serves to drain off water from the water separator 8.

The buffer tank 10 is connected to a pressure tank 17 by a first pipe line or conduit 13 that has a first magnetic valve 14. In addition, a ventilating pipeline or conduit 15 with a magnetic valve 16 also extends between the pressure tank 17 and the buffer tank 10. The pressure tank 17 is supplied with compressed air from pump means 18 which creates a flow of air that passes through a non-return or check valve 19. The pressure tank 17 has an outlet which is connected to a branch line 80 and has a magnetic valve 20. The branch line 80 is connected to a line or another branch 81 at a junction with a supply conduit or pipeline 25. The branch or conduit 81 has a filter 21 and is connected to a coupling means or adapter 22 which couples a feed container 23 to the line 81. The pipeline 25, which has a magnetic valve 24, extends to the injection tank 2 so that by selectively closing the valves 24 and 20, the pressure tank 17 can be connected to the container 23 or the container 23 can be connected directly to the injection tank 2 and be disconnected from the pressure tank 17.

The actual function of the tank system 100 is as follows. So that the black toner powder may be fixed on the endless paper, a constant concentration of the vapor of the solvent must be produced in the fixing station 1 in order to ensure uniform fixing. Since printed paper proceeds at a high speed through the fixing station 1, drifting and condensation on the paper gives rise to a certain discharge of the vapor. This discharge of the vapor can, in fact, be kept very small and entirely harmless both toxicologically and in terms of work safety laws but must nonetheless be compensated for in order to maintain a fixing quality. The same applies to loss of solvent, which occurs as a result of condensation of the vapors of the solvent in the cold sluice and the draining off thereof in the water precipitator or separator 8. For this purpose, a sensor 26 which monitors the concentration of the solvent emits a drive signal to the magnetic valve 4. In response to the drive signal, the magnetic valve 4 will permit a certain quantity of the solvent to flow from the injection tank 2 via the injection pipeline or conduit 5 into the fixing station 1. Since the pipeline 5 discharges near a heated base of the fixing station, the solvent discharged into the station will be rapidly evaporated and thus enrich the vapor concentration of the solvent in the station 1.

The solvent is fed through the tank system via an aerosol container 23. In this special application the aerosol container 23 is filled with solvent to only approximately 90% of its volume with the remaining 10% of the containers volume being filled with normal air. Consequently, the aerosol container contains no propellent gas additives. The aerosol container 23 itself can be inserted in an accommodating device with the assistance of a snap closure and a special coupling component which will be referred to in the following description as an adapter 22. The adapter 22 ensures further sealing from the exterior and at the same time opens the aerosol valve which is provided on the container.

The injection tank 2 contains a level regulating device in the form of the float 3, which will monitor the level of the solvent. If the level falls to a specific value, the level sensor 126, which is coupled to the float 3 will emit a start signal for the refilling process which will be described in the following. It should be noted that the solvent continues to be supplied as to the station 1 when it is required from the residue in the injection tank to the fixing tank 1 via the magnetic valve 4 independently of the other processes. When the level sensor 126 responds to a low level indication, the magnetic valves 14 and 16 are closed simultaneously whereupon the magnetic valve 20 is opened and the air pump 18 is switched on. In this way, the air pump 18 is able to build up a cushion of compressed air, which in this case amounts to approximately 2 bar, in the pressure tank and in the branch lines 80 and 81 as well as in the aerosol container 23.

When the magnetic valve 24 is opened, the cushion of compressed air is able to displace the solvent out of the aerosol container 23 into the injection tank 2. If the sensor 126 reports that an adequate level has been reached in the tank 2, the magnetic valve 24 is closed in order to interrupt the refilling process. If after an elapse of a determined preset length of time the sensor 126 reports that an adequate level has still not been reached, this absence of a signal is interpreted as an indication that the aerosol container is empty and a display of this condition is set forth on a warning display 27 which may be a luminous display. The aerosol container 23 can then be exchanged for a full one. The injection tank 2 will contain an adequate reserve quantity of solvent in order to bridge the time loss for the phases of recognizing that the container 23 is empty, exchanging it and/or the transit time of one entire pressure cycle.

While the device is in operation and while the desired vapor concentration of the solvent is being maintained, the condensate is produced continuously in the fixing station to a greater or lesser degree. For reasons of economy this condensate is returned to the filling system. Since the condensate contains water, the water must be separated before returning the solvent to the system in order to avoid disturbances in the operating flow in which case an accumulation of water in the injection tank can lead to damage to the regulating properties of the overall system. Since the specific densities of the solvent and the water are distinctly different, these substances can be easily separated with the aid of a water separator 8 which contains a simple chamber system.

From the water separator 8, the water which is separated from the condensate is discharged through a pipeline or conduit 12 to a vaporizer system 28. The pure solvent condensate will flow through the conduit or pipeline 9 to the buffer tank 10. From the buffer tank 10 the solvent can then pass through the conduit 13 and through the magnetic valve 14, which is open between the pump phases, into the pressure tank 17. Simultaneously to the magnetic valve 14 being opened, the magnetic valve 16 in the ventilation conduit 15 is also opened so that the pressure tank is ventilated during the filling process. If the level sensor 126 in response to the float 3 reports that the solvent is required in the injection tank 2 as already described, the magnetic valves 14 and 16 are closed and the magnetic valve 20 is then opened as the air pump 18 is switched on. During this pumping process, the solvent content of the pressure tank 17 is thus displaced into the aerosol container 23 and is thus returned to the filling system or supply means.

At the end of the pumping process, the valve 20 is closed and the pump 18 is switched off. This time, a corresponding inner pressure prevails in the pressure tank 17 and when the magnetic valves 14 and 16 are opened, this pressure will lead to a powerful blowing through of these two valves. This blow through can thus be used for the cleansing of these valves and conduits. The pressure subsequently falls in the considerably larger buffer tank 10 and is finally dissipated in the water separator 8. Here again, the temporary repression can be exploited to remove dirt deposits from the feed conduits or pipes for the solvent outlet which will extend some distance to the base of the water separator. Finally, the pressure is completely removed via the ventilating pipe 11 which extends to the fixing station 2.

Figure 3:
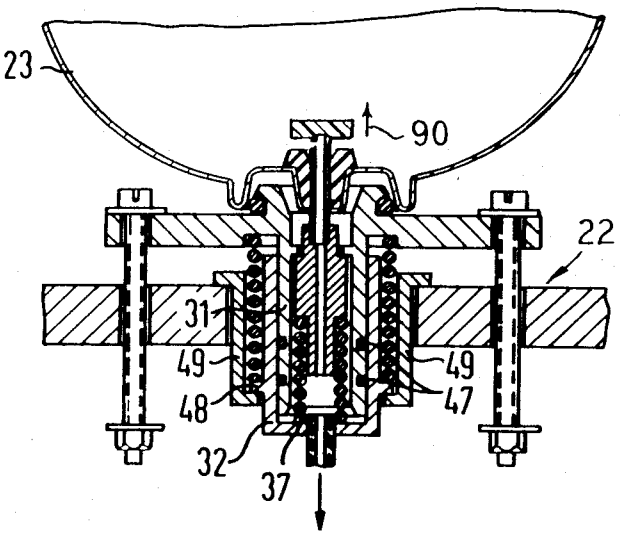
FIG. 3 is a cross sectional view similar to FIG. 2 of the coupling device with the tank being connected thereto.
Figure 2:
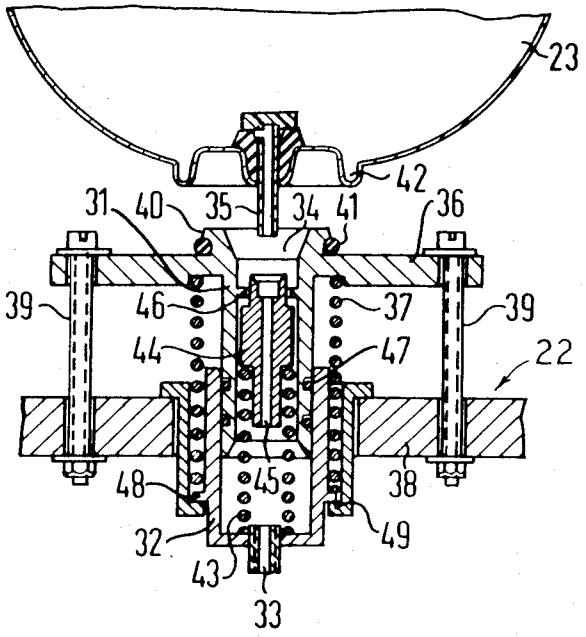
FIG. 2 is an enlarged cross sectional view of a coupling device between the feed container and the tank system with the feed container removed therefrom.

The adapter 22 or coupling means is best illustrated in FIGS. 2 and 3 and is provided in the tank system to enable the exchangeable coupling of an aerosol container 23 into and out of the system. This adapter consists of two tubes 31 and 32 which are engaged telescopically within one another with the lower stationary tube 32 being connected via an opening 33 to the line such as 81 of the tank system. The tube 31 is illustrated as being integrally connected to a spring mounted bearing plate 36 which possesses a central opening 34 for the aerosol container valve 35. The upper surface of the bearing plate 36 is provided with an annular sealing bead 40, which has a groove which receives a sealing ring such as an O-ring 41. The bearing plate 36 is loosely attached to an accomodating housing 38 by threaded members such as 39 and as illustrated is biased away from the housing 38 by a spring 37. When the aerosol container 23 is coupled to the adapter, the sealing bead 40 together with the sealing ring 41 cooperate with a bead 42 of the aerosol container and seal off the valve chamber before the valve 35 is opened.

For the opening of the valve 35, a core tappet 44, which can be displaced via a spring 43 and which is provided with a central opening 45, is arranged centrally in the tube 31. A stop means 46, which forms part of the upper tube 31 ensures the necessary spacing between the core tappet 44 and the valve 35 so that during the actual coupling process the valve chambers is sealed via the bead 40 before the core tappet 44 actuates a valve 35 by shifting it in a direction of arrow 90 (FIG. 3). At this time as illustrated in FIG. 3, the entire weight of the aerosol container 23 is supported by the bearing plate 36 and the bearing plate is lowered as illustrated with the tubes 31 and 32 engaged telescopicly. The telescopic connection between the tubes 31 and 32 is sealed by a pair of sealing rings such as O-rings 47.

The lower tube 32 is received in a cup like guide tube 49, which is suspended in the housing 38 with the position of the tube 32 being determined by stop means such as 48 which are part of the tube. The inner space between the lower tube 32 and the guide tube 49 serves to accomodate a portion of the spring 37 which supports the plate 36.

Figure 4:
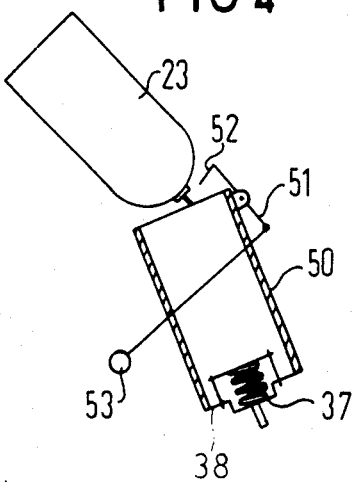
FIG. 4–7 schematically illustrate a locking device or arrangement which serves to secure the feed container on the coupling device with FIG. 4 illustrating the locking device with the container just being inserted therein.
Figure 5:
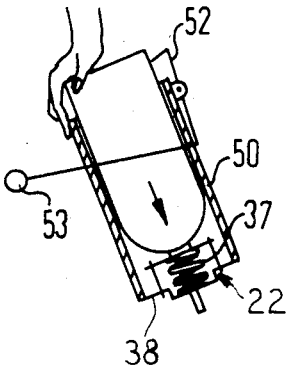
Figure 6:
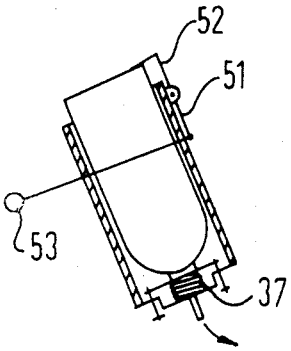
Figure 7:
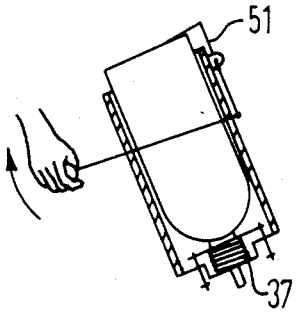

A snap closure locking system is illustrated in FIGS. 4–7 and is provided to facilitate a simple coupling of the aerosol container 23 to the tank system. This locking system consists as schematically illustrated with a tubular bottle guide 50 which is supported on the housing 38. A swing lever 51 is pivotally mounted adjacent the upper edge of the guide 50 and has an associated locking attachment 52. The locking attachment 52 curves slightly inward so that when the aerosol container is introduced into the guide 50, as shown in FIG. 4, the aerosol container 23 will move the swing lever 51. When the container 23 has been inserted into the guide 50 as shown in FIG. 5 by overcoming the spring force of the spring 37, the locking attachment 52 will become engaged over the base of the aerosol container 23 as a result of a counter weight 53 so that the aerosol container is secured in the bottle guide as illustrated in FIG. 6. When the aerosol container is to be removed, the closing weight 53 is gripped as illustrated in FIG. 7 and moved or swung upward in a clockwise direction as indicated by the arrow. The aerosol container is thus released and the spring 37 decouples the container from the tank system. It can then be easily picked up and removed from the bottle guide.

Although various minor modifications may be suggested by those versed in the art it should be understood that I wish to embody within the scope of the patent granted hereon all such modifications as reasonably and properly come within the scope of my contribution to the art.

I claim:

1. In a tank system for cold fixing a toner powder on a paper as it is conducted through a fixing station of a non-mechanical high speed printing and copying device by exposing the printed paper to an atmosphere enriched with vapors of a fixing agent, said tank system including a fixing station having an injection tank containing the fixing agent and having means for creating a vapor of the agent in the fixing station, means for collecting a condensate of the vapor of the fixing agent and delivering the condensate to recovery means for separating the fixing agent from the collected condensate, and supply means for providing an agent to the injection tank including an exchangeable feed container the improvements comprising the system including a pressure tank having an outlet connected to the supply means, a buffer tank for receiving the agent from the recovery means and being connected to the pressure tank by a valve controlled conduit, pump means for applying an air pressure in the pressure tank to cause a flow of the agent into the supply means and the feed container, and control means for actuating the pump means in response to a sensed low level of the agent in the injection tank.

2. In a tank system according to claim 1, wherein the valve controlled conduit is a supply conduit containing a first valve and said buffer tank is also connected by a ventilating conduit having a second closable valve to the pressure tank.

3. In a tank system according to claim 2, wherein the supply means includes a supply conduit extending from a coupling for the feed container to the injection tank and having a third valve, and a filling branch with a fourth valve extending from the pressure tank and being connected to the supply conduit at a point between the coupling and the third valve so that the coupling for the feed container can be selectively connected to the pressure tank and to the injection tank.

4. In a tank system according to claim 1, wherein the supply means includes a coupling for detachably connecting the feed container to said supply means, each of said feed containers being provided with a valve terminal surrounded by an annular shoulder, said coupling having a first tube connected to a bearing plate with the interior tube being in communication with a central opening for receiving the valve of the container, said central opening being surrounded by a sealing bead coacting with the annular shoulder of the container to form a seal therebetween, said first tube being telescopicly received in a second tube having a connection for a supply conduit, a core tappet being disposed in the first tube and urged towards a first position by a spring, said core tappet engaging the valve of the container and actuating said valve after the container is completely sealed on the sealing bead.

5. In a tank system according to claim 4, wherein the sealing bead of the bearing plate includes an elastic sealing ring.

6. In a tank system according to claim 5, wherein the supply means includes a tubular bottle guide secured to the coupling, a swing lever pivotally connected to the bottle guide adjacent an upper edge, said swing lever on one end having a locking attachment for engaging a bottom of a container to press the container against the bearing plate.

7. In a tank system according to claim 6, wherein the spring lever has a closing weight on the other end for urging the lever to a position with the locking attachment engaging the container, said locking attachment being shaped in such a manner that when the container is introduced into the bottle guide, the swing lever is pivoted from said position and subsequent to the introduction of the container into the guide the lever urges the attachment to said position for locking the container in said guide.

8. In a tank system according to claim 4, wherein the second tube is connected to a housing plate, a guide tube being mounted on said housing plate, a swing lever pivotally mounted on the guide tube adjacent an upper edge, said swing lever having a locking engagement means on one end for engaging a bottom of a container inserted in said guide tube to urge said container against the bearing plate.

9. In a tank system according to claim 8, wherein the other end of the swing lever has a weighted lever which urges the swing lever to a postion with the locking engagement engaging the bottom of a container in the guide tube, said locking engagement being shaped so that following the introduction of a container into the guide tube, the weighted handle causes the locking engagement to engage the bottom of the container.

10. In a tank system according to claim 1 wherein the supply means includes a supply conduit extending from the injection tank to a coupling for connecting to the feed container, said supply conduit having valve means for regulating the flow therethrough, a branch connection connected to said supply conduit between the valve means and coupling having a controllable valve for regulating the flow from the pressure tank to the first mentioned supply conduit.

* * * * *